US011946217B1

(12) United States Patent
Ding et al.

(10) Patent No.: US 11,946,217 B1
(45) Date of Patent: Apr. 2, 2024

(54) TOP PLATE JACKING DEVICE AND JACKING CONSTRUCTION METHOD CONFIGURED FOR V-SHAPED COLUMNS

(71) Applicants: China Railway Tunnel Group Co., Ltd., Guangdong (CN); China Railway Tunnel Group Third Division Co., Ltd., Guangdong (CN)

(72) Inventors: Jialiang Ding, Guangdong (CN); Xin Zhang, Guangdong (CN); Fuxian Yu, Guangdong (CN); Huiwen Ding, Guangdong (CN); Min Cao, Guangdong (CN); Xianhai Tang, Guangdong (CN); Ning Ma, Guangdong (CN); Baixi Feng, Guangdong (CN); Xin Wen, Guangdong (CN)

(73) Assignees: China Railway Tunnel Group Co., Ltd., Guangdong (CN); China Railway Tunnel Group Third Division Co., Ltd., Shenzhen (CN)

( * ) Notice: Subject to any disclaimer, the term of this patent is extended or adjusted under 35 U.S.C. 154(b) by 0 days.

(21) Appl. No.: 18/369,253

(22) Filed: Sep. 18, 2023

(51) Int. Cl.
*E02D 29/00* (2006.01)
*E02D 27/14* (2006.01)
*E02D 29/045* (2006.01)

(52) U.S. Cl.
CPC ..... *E02D 29/045* (2013.01); *E02D 27/14* (2013.01)

(58) Field of Classification Search
CPC ..... E02D 29/00; E02D 29/04; E02D 29/045; E02D 27/14
See application file for complete search history.

(56) References Cited

U.S. PATENT DOCUMENTS 4,338,047 A * 7/1982 David ..... E02D 27/48 405/230
2004/0141814 A1* 7/2004 Covington ..... E02D 35/00 405/230
2022/0098817 A1* 3/2022 Kim ..... E02D 29/055

FOREIGN PATENT DOCUMENTS

CN 108265618 A 7/2018
CN 210684475 U 6/2020
CN 111691456 A 9/2020
CN 114790757 A 7/2022
CN 115233730 B 7/2023
GB 1065542 A 4/1967
(Continued)

*Primary Examiner* — Kyle Armstrong
(74) *Attorney, Agent, or Firm* — Cooper Legal Group, LLC

(57) ABSTRACT

The present application relates to a top plate jacking device and jacking construction method configured for V-shaped columns, the top plate jacking device comprising a temporary support pile comprises a plurality of pile holes arranged on a construction surface, a bottom end of the pile hole is cast-in-place with a bearing platform, a temporary support column is inserted on the bearing platform, a plurality of pillars are fixed at a top of the temporary support column, wherein comprises a plurality of vertically connected column segments, two adjacent column segments detachably connected vertically through a connecting component; a support block is provided at a top of the plurality of pillars, the top of the support block abuts against a lower surface of the top plate; a hydraulic jack is configured to jack the top plate and is provided with a plurality of intervals at the top of the temporary support column.

11 Claims, 3 Drawing Sheets

(56) References Cited

FOREIGN PATENT DOCUMENTS

| | | | | |
|---|---|---|---|---|
| KR | 200454162 | Y1 | * | 2/2011 |
| KR | 20160131410 | A | * | 11/2016 |

* cited by examiner

TOP PLATE JACKING DEVICE AND JACKING CONSTRUCTION METHOD CONFIGURED FOR V-SHAPED COLUMNS

TECHNICAL FIELD

The present application relates to a technical field of subway roof construction jacking, and in particular, relates to a top plate jacking device and jacking construction method configured for V-shaped columns.

BACKGROUND ART

During a construction of an core area of a subway station, a cover excavation reverse method is adopted on a construction surface, with a plurality of temporary steel pipe concrete columns as vertical supports in the middle, after permanent V-shaped columns of steel-concrete composite structure are completed and meet strength requirements, a system transformation is completed according to a design force conversion principle, and the temporary steel pipe concrete columns are removed from bottom to top.

In a construction stage, after the transformation of a stress system is completed, a steel cushion block at a top of the column is extracted and the temporary steel pipe concrete column is removed section by section from top to bottom. A segmentation height is determined based on a crane position, an extension distance of a crane arm, and an allowable jacking weight. First, chiseling off the concrete at an edge of the pipe wall symmetrically along a diameter direction at the top of the column, using a gas cutting to blow a hole as a fixing point of a shackle, after a jacking is stable, adopting a gas flame to cut off a circumferential steel plate at a segmentation position, the concrete in the column is drilled with an air pick, and a drilling steel is lifted and broken, an operating platform is an aerial work platform.

During the above construction process, construction personnel are required to work at heights throughout an entire process, and construction steps are complex and difficult, there is a room for improvement.

SUMMARY

In order to reduce a difficulty of high-altitude operations for construction personnel and simplify construction steps, the present application provides a top plate jacking device and jacking construction method configured for V-shaped columns.

A top plate jacking device and jacking construction method for V-shaped columns provided in the present application adopts the following technical solution:

A top plate jacking device for V-shaped columns, comprising a temporary support pile, wherein the temporary support pile comprises a plurality of pile holes arranged on a construction surface, a cast-in-place bearing platform is provided at a bottom end of each of the plurality of pile holes, a temporary support column is inserted on the bearing platform, a plurality of pillars are fixed at a top of the temporary support column, the temporary support column comprises a plurality of vertically connected column segments, and two adjacent column segments are detachably connected vertically with each other with a connecting component;

a support block, that is provided at a top of the plurality of pillars, and the top of the support block abuts against a lower surface of the top plate;

a hydraulic jack, configured to jack the top plate and the hydraulic jack is provided with a plurality of intervals at the top of the temporary support column.

By adopting the above technical solution, during construction, the pile hole is drilled on the construction surface, and the bearing platform is poured at the bottom of the pile hole, the plurality of prefabricated column segments are connected on the construction surface, and then the temporary support pile is jacked and placed into the pile hole, the temporary support pile is inserted on the bearing platform, and then the support blocks are placed on the plurality of pillars, finally, the top plate is placed on the plurality of support blocks to form a temporary support to the top plate, the hydraulic jack is connected to the top of the temporary support column; after the construction of the V-shaped columns is completed and a strength requirement is met, the hydraulic jack is started to jack the top plate up a certain distance, the support block is pulled out, and a space is left for the temporary support column to be removed, the hydraulic jack is removed; the construction personnel first remove the connection between the two vertically adjacent column segments, and then jack the upper column segment upwards through a crane and a sling, so that after the upper column segment is completely detached from a remaining part of the temporary support column, the column segment is jacked and moved horizontally to one side, and dispose of the jacking to a foundation pit ground; by providing the temporary support column as a plurality of easily detachable column segments, a difficulty of high-altitude operations for the construction personnel is reduced, construction steps are simplified, a time cost is shorten, a safety of the construction personnel is ensured, thereby providing a good reference function for similar projects in the future.

In an embodiment, the connecting component comprises an upper abutting seat and a lower abutting seat, there are a plurality of upper abutting seats and lower abutting seats are evenly at intervals along a circumferential direction of the column segment, a circular structure formed by the upper abutting seat and the circular structure formed by the lower abutting seat are mutually sleeved to limit a horizontal movement of the column segment, and a limiting rod group passes through and is provided between the upper abutting seat and the lower abutting seat.

By adopting the above technical solution, when the temporary support column is assembled, the column segment is jacked from bottom to top, when the two adjacent column segments located above and below are connected, a circular structure formed by the upper abutting seat, and the circular structure formed by the lower abutting seat are mutually sleeved to limit a horizontal movement of the column segment, and the upper abutting seat is connected to the lower abutting seat through a limiting rod group to achieve the connection between the two adjacent column segments located above and below.

In an embodiment, a number of the upper abutting seat and the lower abutting seat is an even number, and the limiting rod group comprises a limiting screw and a limiting nut threaded to the limiting screw, the limiting screw passes through and is provided between the upper abutting seat and the lower abutting seat at radial ends of the column segment and the limiting screw is compressed tightly by the limiting nut.

By adopting the above technical solution, the connection between the upper abutting seat and the lower abutting seat is achieved through a combination of the limiting screw and the limiting nut, when connecting, the construction personnel only need to pass the limiting screw through the upper abutting seat and the lower abutting seat from the outside to reduce a difficulty of an operation.

In an embodiment, a guide plate is fixed on an outer wall of the lower column segment, the guide plate tilts and extends outward, and there are a plurality of guide plates evenly at intervals along the circumferential direction of the column segment.

By adopting the above technical solution, when the upper column segment located below, the guide plate plays a guiding role in placing the column segment below, so that allowing the upper column segment to quickly and accurately align with the lower column segment.

In an embodiment, the plurality of guide plates are detachably connected to the column segment through an anchor ear.

By adopting the above technical solution, after the column segment is connected to the outside of the pile hole to form the temporary support column, the guide plate is removed from the column segment to facilitate a placement of the temporary support column.

In an embodiment, the guide plate and the limiting screw are provided in a staggered manner.

By adopting the above technical solution, different components are arranged reasonably to avoid interference between different components during the assembly process of the column segment.

In an embodiment, the support block comprises an inclined plate and two flat plates, the two flat plates and the inclined plate are arranged in a Z-shaped pattern, two ends of the inclined plate are hinged to the two flat plates, and an end of the flat plate that is hinged departing from the inclined plate is provided with a support plate, the support plate is vertically provided, and a first end of the support plate is slidably connected to the flat plate, a second end of the support plate is hinged with a hinged seat, the hinged seat is slidably connected to the inclined plate, a locking element is provided between the support plate and the flat plate for locking, an output end of the hydraulic jack abuts against a lower surface of the flat plate located above, driving the flat plate to move up and abut against the top plate.

By adopting the above technical solution, enable the support block to better adapt to a working condition in the present application; due to an use of cast-in-place bearing platform construction in the present application, there is an inevitably height error between different bearing platforms, by setting the support block as a prefabricated structure with an adjustable height, the hydraulic jack drives the inclined plate to rotate, thereby driving the support plate to move, and adjusting the height of the flat plate located above to make it abut against the top plate, after the adjustment is completed, the hydraulic jack resets, installing wooden formworks on both sides of the support block and pouring a concrete into the support block, after a final setting of the concrete, the support block forms a stable whole with a constant height, providing a support to the top plate, ensuring that the top surfaces of different support block are at the same height to ensure the best support effect for the top plate.

In an embodiment, the locking element comprises an angle steel fixed on the support plate and a connecting bolt configured to connect the angle steel and the flat plate.

By adopting the above technical solution, the connection between the support plate and the flat plate is achieved through the combination of the angle steel and the connecting bolt, with high connection stability.

In an embodiment, a counter weight block is provided on the flat plate located above.

By adopting the above technical solution, a stability of the support block is increased to prevent the lower flat plate from moving up during the hydraulic jack jacking of the upper flat plate.

A jacking construction method by using the top plate jacking device for V-shaped columns, comprising the following steps:

S1. drilling a pile hole at a specified location on the construction surface and pouring a bearing platform at a bottom of the pile hole;

S2. assembling the prefabricated column segments on an outside of the pile hole, and connecting the adjacent column segments above and below through the connecting component, after a connection is completed, hanging the temporary support pile vertically into the pile hole, so that a bottom of the temporary support pile is inserted on the bearing platform;

S3. after placing the support block on the plurality of pillars, mounting the hydraulic jack at the top of the temporary support column, and placing the top plate on a plurality of support blocks to form a temporary support to the top plate;

S4. after the construction of the V-shaped columns is completed and a strength requirement is met, starting the hydraulic jack to jack the top plate up a certain distance and pulling out the support block;

S5. removing the hydraulic jack;

S6. releasing the connection between the two adjacent vertical column segments, and removing the column segment through a cooperation of a crane and a sling.

By adopting the above technical solution, by arranging the structure and the construction steps reasonably, the roof can be jacked and the temporary jacking structure can be quickly removed, a difficulty of a high-altitude operation for construction personnel is reduced and the operation steps are simplified, making it suitable for subsequent promotion and application.

In summary, the present application includes at least one of the following beneficial technical effects:

1. by providing the temporary support column as a plurality of easily detachable column segments, a difficulty of high-altitude operations for the construction personnel is reduced, construction steps are simplified, a time cost is shorten, a safety of the construction personnel is ensured, thereby providing a good reference function for similar projects in the future;
2. due to the use of cast-in-place bearing platform construction in the present application, there is the inevitably height error between different bearing platforms, by setting the support block as the prefabricated structure with the adjustable height, the hydraulic jack drives the inclined plate to rotate, thereby driving the support plate to move, and adjusting the height of the flat plate located above to make it abut against the top plate, after the adjustment is completed, the hydraulic jack resets, installing wooden formworks on both sides of the support block and pouring the concrete into the support block, after the final setting of the concrete, the support block forms the stable whole with the constant height, providing the support to the top plate, ensuring that the top surfaces of different support block are at the same height to ensure the best support effect for the top plate.

DETAILED DESCRIPTION

The present application is further described in detail below with reference to FIGS. 1-3.

A top plate jacking device and jacking construction method configured for V-shaped columns is provided according to an embodiment of the present application.

Figure 1:
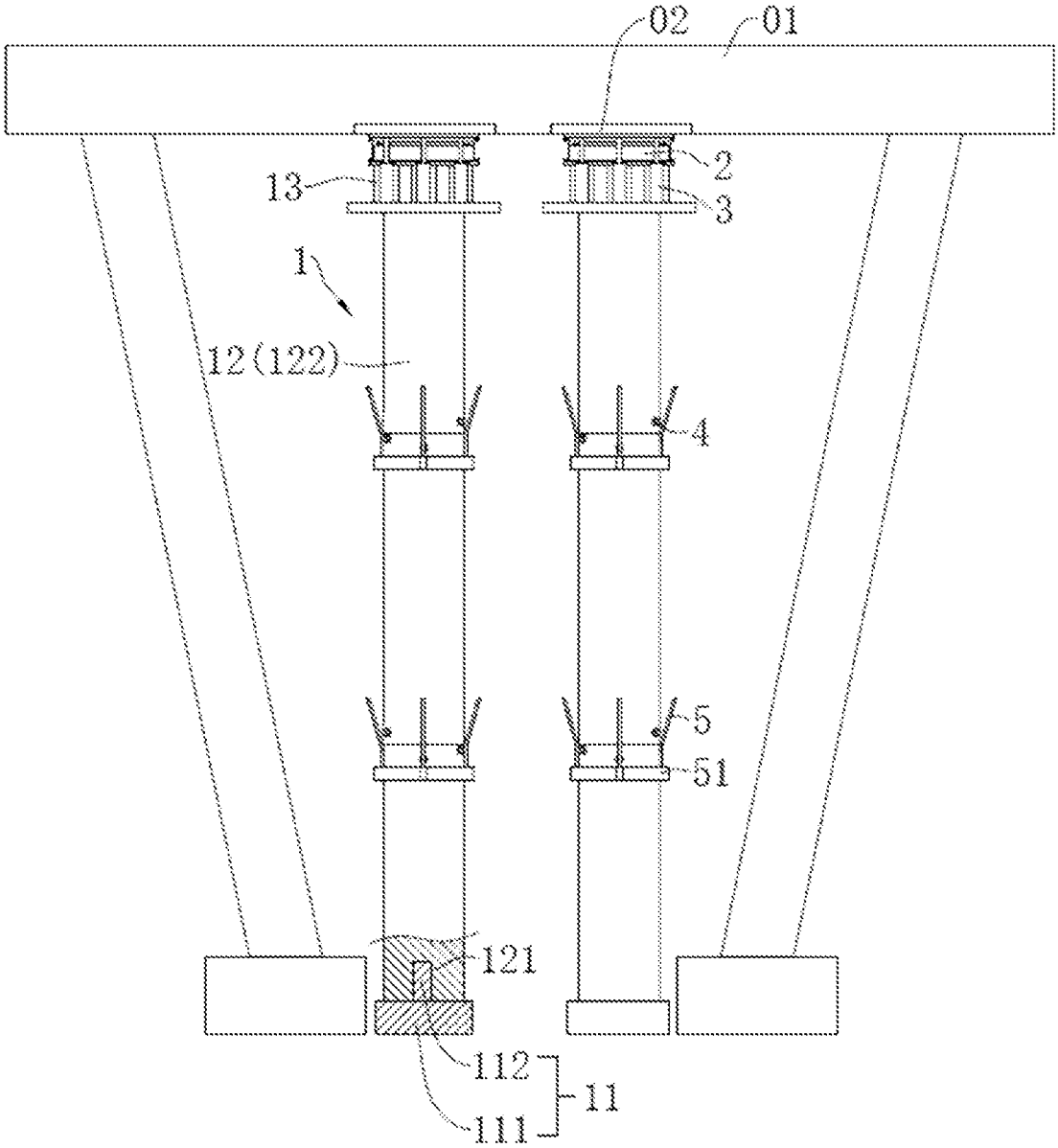
FIG. 1 is a schematic view showing a top plate, an embedded steel plate, a V-shaped columns, and a top plate jacking device in the present application.

Referring to FIG. 1, a top plate jacking device configured for V-shaped columns, including a temporary support pile 1, a support block 2 provided on a top of the temporary support pile 1 and a hydraulic jack 3, the support block 2 is configured to abut against a lower surface of a top plate 01, and the hydraulic jack 3 is configured to adjust a height of the support block 2 and drive the top plate 01 to move up.

There are a plurality of temporary support piles 1 arranged in a rectangular pattern between the V-shaped columns. The temporary support pile 1 includes a pile hole arranged on a construction surface, a cast-in-place bearing platform 11 is provided on a bottom wall of the pile hole, a temporary support column 12 is inserted on the bearing platform 11, and a plurality of pillars 13 are fixed at a top of the temporary support column 12.

The bearing platform 11 includes a base portion 111 and an insertion portion 112 for providing a insertion foundation for the temporary support column 12, the temporary support column 12 is defined with an insertion slot 121 for a vertical insertion and a coordination with the insertion portion 112.

The temporary support column 12 includes a plurality of vertically connected column segments 122, and any two adjacent column segments 122 can be detachably connected through a connecting component 4.

By opening the pile hole on site, laying the bearing platform 11, and providing a plurality of detachable column segments 122, condition is provided for a removal of a temporary support system when adjusting a stress system during a subsequent construction of the V-shaped columns.

Figure 2:
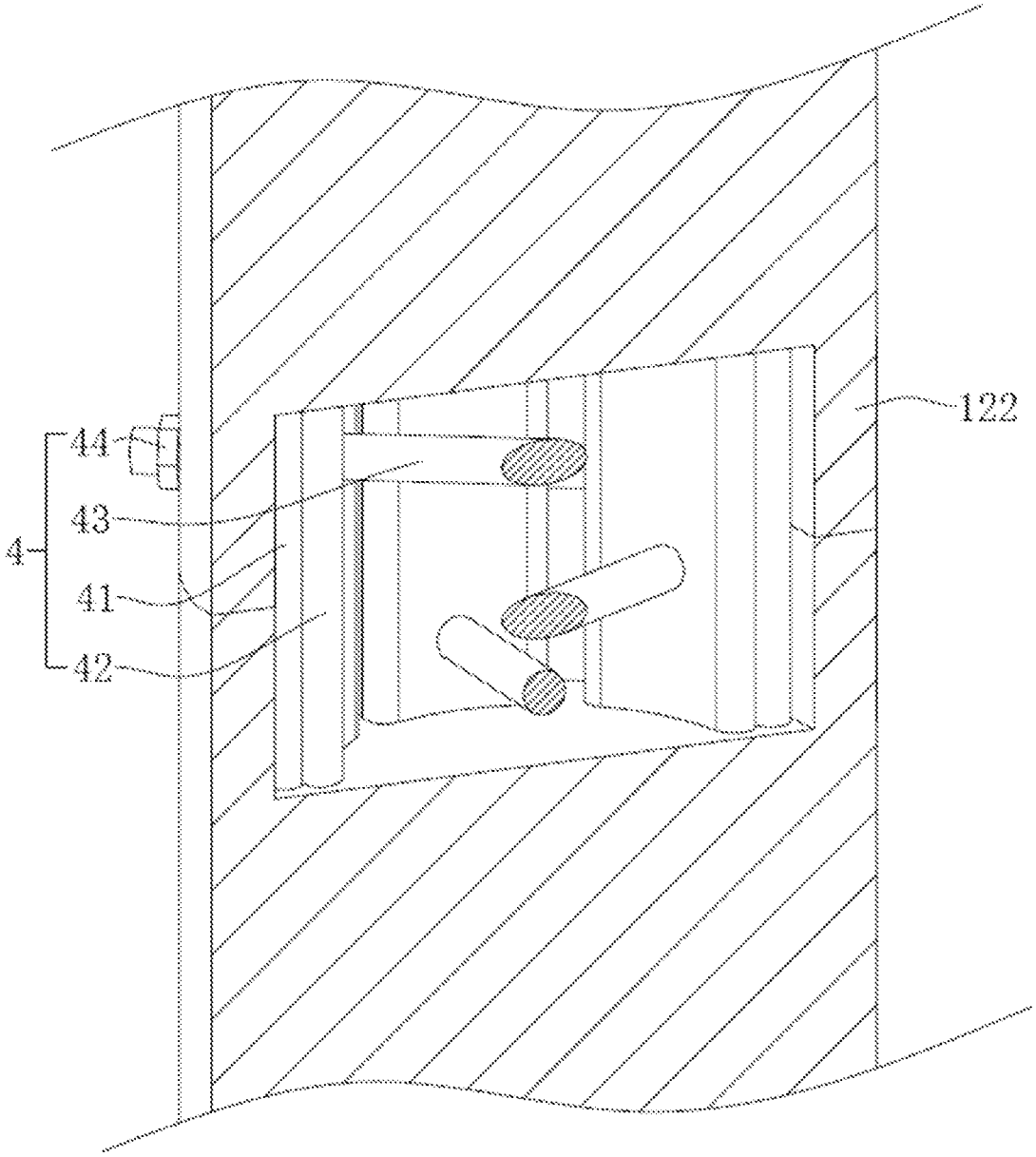
FIG. 2 is a partial schematic cross-sectional view showing a structure of a connecting component.

Referring to FIGS. 1 and 2, specifically, a bottom end of the upper column segment 122 is defined with an upper accommodating slot, and a top end of the lower column segment 122 is defined with a lower accommodating slot. The connecting component 4 includes an upper abutting seat 41 fixed at a top of the upper column segment 122, a lower abutting seat 42 fixed at a bottom of the lower column segment 122, and a limiting rod group for connecting the upper abutting seat 41 and the lower abutting seat 42, the upper abutting seat 41 and the lower abutting seat 42 are located in a space formed by a abutting of the upper accommodating slot and the lower accommodating slot.

The upper abutting seat 41 is arranged in an arc shape, and there are even numbers of upper abutting seats 41 are evenly at intervals along a circumferential direction of the column segments 122; the lower abutting seat 42 is arranged in the arc shape that is suitable for the upper abutting seat 41, there are even numbers of lower abutting seats 42 are evenly at intervals along the circumferential direction of the column segment 122, and the lower abutting seat 42 is located on an inner side of the upper abutting seat 41; after the two adjacent column segments 122 are connected, a circular structure formed by the upper abutting seat 41, and the circular structure formed by the lower abutting seat 42 are mutually sleeved to limit a horizontal movement of the column segment 122.

The limiting rod group includes a limiting screw 43 that horizontally passes through between the upper abutting seat 41 and the lower abutting seat 42 at radial ends of the column segments 122, two ends of the limiting screw 43 are respectively threaded and connected with limiting nuts 44, which abut against an outer wall of the column segment 122. When the construction personnel connect the two adjacent column segments 122 above and below, the construction personnel only need to horizontally pass the limiting screw 43 through the column segments 122 and tighten the limiting nuts 44 on both ends of the limiting screw 43, making it convenient for the construction personnel to operate.

In order to ensure a smooth abutting between the upper abutting seat 41 and the lower abutting seat 42, the outer wall of the lower column segment 122 is provided with a guide plate 5, the guide plate 5 tilts and extends outward, and there are a plurality of guide plates 5 are evenly at intervals along the circumferential direction of the column segment 122 and the guide plate 5 and the limiting screw 43 are provided in a staggered manner. Bottom ends of a plurality of guide plates 5 provided in a circumferential direction are jointly fixed to a same anchor ear 51, which is tightly connected to an outer side of the column segment 122.

Figure 3:
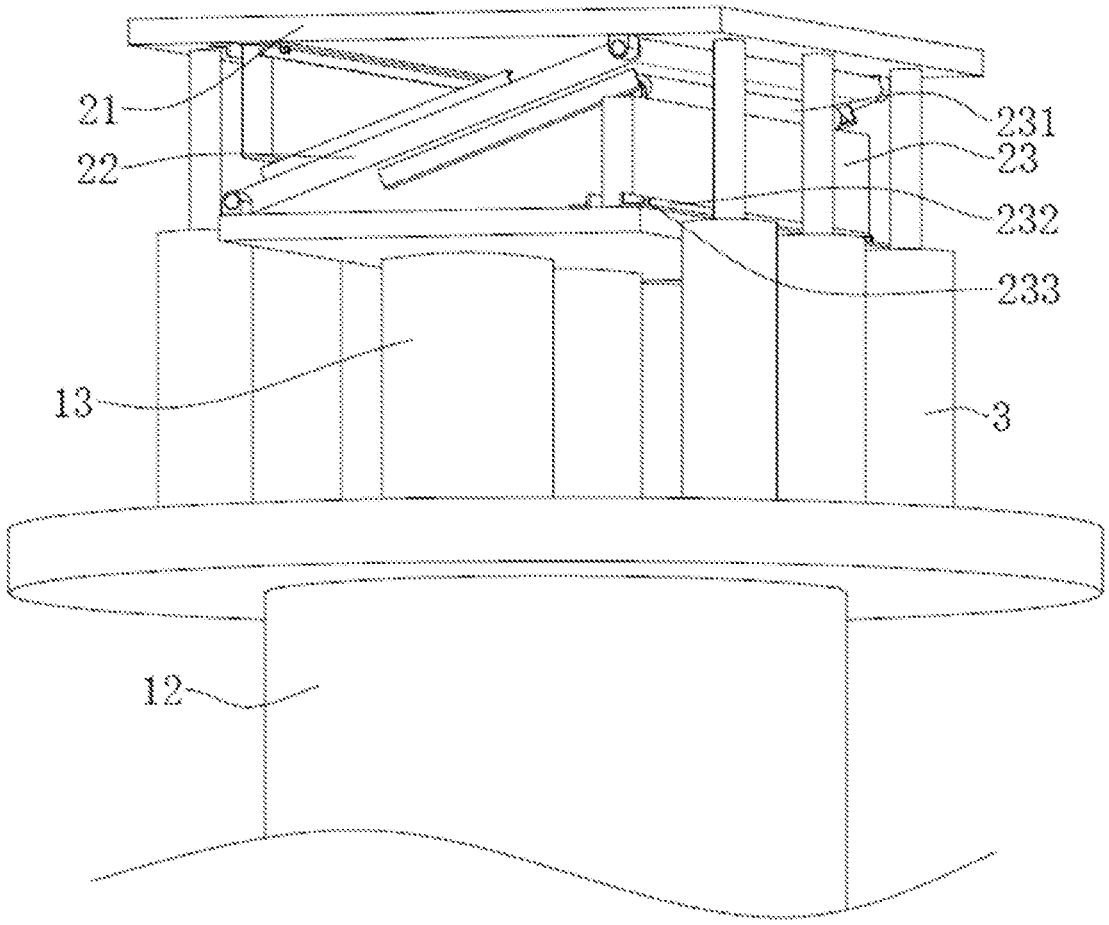
FIG. 3 is a partial structural view showing a structure of a column segment, a pillar, a support block, and a hydraulic jack.

Referring to FIGS. 1 and 3, the support block 2 includes two flat plates 21 provided in parallel up and down and an inclined plate 22 between the two flat plates 21, two ends of the inclined plate 22 are hinged on an opposite sides of the two flat plates 21, forming a Z-shaped structure together with the two flat plates 21. Wherein the flat plate 21 located above is the top plate 01, and the flat plate 21 located below is a bottom plate, a length of the top plate 01 is greater than a length of the bottom plate, and a counter weight block is provided on the bottom plate, the counter weight block is not shown in the attached figure.

An end of the flat plate 21 departing from its hinged end slides along an extension direction of the flat plate 21 and is connected to a support plate 23, the support plate 23 is vertically provided, and a top of the support plate 23 is hinged with a hinged seat 231, which slides and is connected to the inclined plate 22; two sides of the support plate 23 facing the end of the flat plate 21 are respectively welded with an angle steel 232, the angle steel 232 is threaded to the flat plate 21 through a connecting bolt 233, during the construction process, a connection between the angle steel 232 and the flat plate 21 can be achieved by on-site drilling on the bottom plate.

In addition, in order to reduce a damage to the top plate 01 during a jacking process, an embedded steel plate 02 is provided on a corresponding position between the top plate 01 and the temporary support column 12.

A jacking construction method using the top plate jacking device configured for V-shaped columns, comprising the following steps:

S1. drilling a pile hole at a specified location on the construction surface, there are a plurality of pile holes are evenly at intervals in a rectangular pattern between V-shaped columns, and the bearing platform 11 are poured at a bottom of the pile holes.

S2. assembling the prefabricated column segments 122 from bottom to top on the outer side of the pile holes;

when the construction personnel connect the two adjacent column segments 122 above and below, the upper column segment 122 is jacked to align with the lower column segment 122, the circular structure formed by the upper abutting seat 41 and the circular structure formed by the lower abutting seat 42 are mutually sleeved to limit the horizontal movement of the two adjacent column segments 122 above and below, the limiting screw 43 horizontally passes through the column segment 122, and the limiting nut 44 is tightened at both ends of the limiting screw 43, thereby limiting a vertical movement of the two adjacent column segments 122 above and below;

after the connection is completed, the temporary support pile 1 is hanged vertically into the pile hole, so that a bottom end of the temporary support pile 1 is inserted on the bearing platform 11.

S3. placing the support block 2 on the plurality of pillars 13, and mounting the hydraulic jack 3 at the top of the temporary support column 12, the hydraulic jack 3 is tightly connected to the temporary support column 12 through bolts, so that an output end of the hydraulic jack 3 can abut against the lower surface of the top plate 01;

adjusting the hydraulic jack 3 so that the output end of the hydraulic jack 3 abuts against the lower surface of the top plate 01, adjusting a height of the top plate 01 until a top surface of the support blocks 2 in all temporary support piles 1 are at the same level;

installing wooden formworks on both sides of the support block 2 and pouring a concrete into the support block 2, after a final setting of the concrete, the support block 2 forms a stable whole with a constant height, placing the top plate 01 on a plurality of support blocks 2 and providing a temporary support to the top plate 01, ensuring that the top surfaces of different support block 2 are at the same height to ensure the best support effect for the top plate 01.

S4. after the construction of the V-shaped columns is completed and a strength requirement is met, adjusting a position of the hydraulic jack 3 so that the output end of the hydraulic jack 3 can abut against the lower surface of the top plate 01;

jacking the jack synchronously, with loading control as a main control, a displacement of the top plate 01 shall not exceed 3 mm, the support block 2 shall be pulled out to stop loading, and do not overload to cause damage to the structure of the top plate 01.

S6. releasing the connection between the hydraulic jack 3 and the temporary support column 12, and jacking the hydraulic jack 3 vertically through a cooperation of a crane and a sling;

S7. the construction personnel first remove the connection between the two vertically adjacent column segments 122, and then jack the upper column segment 122 upwards through the crane and the sling, so that after the upper column segment 122 is completely detached from a remaining part of the temporary support column 12, the column segment 122 is jacked and moved horizontally to one side, and dispose of the jacking to a foundation pit ground, the column segments 122 are removed one by one from top to bottom.

In the present application, by providing the temporary support column 12 as a plurality of easily detachable column segments 122, a difficulty of high-altitude operations for the construction personnel is reduced, construction steps are simplified, a time cost is shorten, a safety of the construction personnel is ensured, thereby providing a good reference function for similar projects in the future.

The above are the preferred embodiments of the present application, which are not intended to limit the protection scope of the present application. Therefore, all equivalent changes made according to the structure, shape and principle of the present application should be covered within the protection scope of the present application.

List of reference signs: 01. top plate; 02. embedded steel plate; 1. temporary support pile; 11. bearing platform; 111. base portion; 112. insertion portion; 12. temporary support column; 121. insertion slot; 122. column segment; 13. pillar; 2. support block; 21. flat plate; 22. inclined plate; 23. support plate; 231. hinged seat; 232. angle steel; 233. connecting bolt; 3. hydraulic jack; 4. connecting component; 41. upper abutting seat; 42. lower abutting seat; 43. limiting screw; 44. limiting nut; 5. guide plate; 51. anchor ear.

What is claimed is:

1. A top plate jacking device for V-shaped columns, comprising:

a temporary support pile, wherein the temporary support pile comprises a plurality of pile holes arranged on a construction surface, a cast-in-place bearing platform is provided at a bottom end of each of the plurality of pile holes, a temporary support column is inserted on the cast-in-place bearing platform, a plurality of pillars are fixed at a top of the temporary support column, the temporary support column comprises a plurality of vertically connected column segments, and two adjacent column segments of the plurality of vertically connected column segments are detachably connected vertically with each other with a connecting component;

a support block that is provided at a top of the plurality of pillars, wherein a top end of the support block abuts against a lower surface of a top plate; and a hydraulic jack, configured to jack the top plate, wherein the hydraulic jack is provided with a plurality of intervals at the top of the temporary support column, wherein the support block comprises an inclined plate, a upper flat plate and a lower flat plate, the upper flat plate, the lower flat plate and the inclined plate are arranged in a Z-shaped pattern, two ends of the inclined plate are hinged to the upper flat plate and the lower flat plate, and an end of each of the upper flat plate and the lower flat plate that is hinged departing from the inclined plate is provided with a support plate, the support plate is vertically arranged, and a first end of the support plate is slidably connected to the upper flat plate or the lower flat plate, a second end of the support plate is hinged with a hinged seat, the hinged seat is slidably connected to the inclined plate, a locking element is provided between the support plate and the upper flat plate or the lower flat plate for locking, and an output end of the hydraulic jack abuts against a lower surface of the upper flat plate for driving the upper flat plate to move up and abut against the top plate.

2. The top plate jacking device configured for V-shaped columns according to claim 1, wherein the connecting component comprises a plurality of upper abutting seats and a plurality of lower abutting seats, which are arranged evenly at intervals along a circumferential direction of at least one of the plurality of vertically connected column segments, a circular structure formed by the plurality of upper abutting seats and a circular structure formed by the plurality of lower abutting seats are mutually sleeved to limit a horizontal movement of the at least one of the plurality of vertically connected column segments, and a limiting rod group passes through and is provided between the plurality of upper abutting seats and the plurality of lower abutting seats.

3. The top plate jacking device for V-shaped columns according to claim 2, wherein the connecting component comprises an even number of the upper abutting seats and an even number of the lower abutting seats, the limiting rod group comprises a limiting screw and a limiting nut threaded to the limiting screw, and the limiting screw passes through and is provided between one of the plurality of upper abutting seats and one of the plurality of lower abutting seats at radial ends of the at least one of the plurality of vertically connected column segments and the limiting screw is compressed by the limiting nut.

4. The top plate jacking device for V-shaped columns according to claim 2, wherein a guide plate is fixed on an outer wall of a lower column segment, the guide plate tilts and extends outward, and a plurality of the guide plates are arranged evenly at intervals along the circumferential direction of the at least one of the plurality of vertically connected column segments.

5. The top plate jacking device for V-shaped columns according to claim 4, wherein the plurality of the guide plates are detachably connected to the at least one of the plurality of vertically connected column segments through an anchor ear.

6. The top plate jacking device for V-shaped columns according to claim 4, wherein the plurality of the guide plates and a limiting screw are provided in a staggered manner.

7. The top plate jacking device for V-shaped columns according to claim 1, wherein the locking element comprises an angle steel fixed on the support plate and a connecting bolt configured to connect the angle steel and the upper flat plate and the lower flat plate.

8. The top plate jacking device for V-shaped columns according to claim 1, wherein a counter weight block is provided on the lower flat plate.

9. A jacking construction method by using the top plate jacking device for V-shaped columns according to claim 1, comprising:

S1. drilling a pile hole at a specified location on the construction surface and pouring the cast-in-place bearing platform at a bottom of the pile hole;

S2. assembling the plurality of vertically connected column segments, which are prefabricated, on an outside of the pile hole, and connecting the two adjacent column segments of the plurality of vertically connected column segments above and below through the connecting component; and after a connection is completed, hanging the temporary support pile vertically into the pile hole, so that a bottom of the temporary support pile is inserted on the cast-in-place bearing platform;

S3. after placing the support block on the plurality of pillars, mounting the hydraulic jack at the top of the temporary support column, and placing the top plate on a plurality of the support blocks to form a temporary support to the top plate;

S4. after construction of the V-shaped columns is completed and a strength requirement is met, starting the hydraulic jack to jack the top plate up a certain distance and pulling out the plurality of the support blocks;

S5. removing the hydraulic jack; and

S6. releasing the connection between the two adjacent column segments, and removing the plurality of vertically connected column segments through a cooperation of a crane and a sling.

10. A top plate jacking device for V-shaped columns, comprising:

a temporary support pile, wherein the temporary support pile comprises a plurality of pile holes arranged on a construction surface, a cast-in-place bearing platform is provided at a bottom end of each of the plurality of pile holes, a temporary support column is inserted on the cast-in-place bearing platform, a plurality of pillars are fixed at a top of the temporary support column, the temporary support column comprises a plurality of vertically connected column segments, and two adjacent column segments of the plurality of vertically connected column segments are detachably connected vertically with each other with a connecting component;

a support block that is provided at a top of the plurality of pillars, wherein a top end of the support block abuts against a lower surface of a top plate; and a hydraulic jack, configured to jack the top plate, wherein the hydraulic jack is provided with a plurality of intervals at the top of the temporary support column;

wherein the connecting component comprises a plurality of upper abutting seats and a plurality of lower abutting seats, which are arranged evenly at intervals along a circumferential direction of at least one of the plurality of vertically connected column segments, a circular structure formed by the plurality of upper abutting seats and a circular structure formed by the plurality of lower abutting seats are mutually sleeved to limit a horizontal movement of the at least one of the plurality of vertically connected column segments, and a limiting rod group passes through and is provided between the plurality of upper abutting seats and the plurality of lower abutting seats.

11. A jacking construction method by using a top plate jacking device for V-shaped columns, wherein the top plate jacking device for V-shaped columns comprises:

a temporary support pile, wherein the temporary support pile comprises a plurality of pile holes arranged on a construction surface, a cast-in-place bearing platform is provided at a bottom end of each of the plurality of pile holes, a temporary support column is inserted on the cast-in-place bearing platform, a plurality of pillars are fixed at a top of the temporary support column, the temporary support column comprises a plurality of vertically connected column segments, and two adjacent column segments of the plurality of vertically connected column segments are detachably connected vertically with each other with a connecting component;

a support block that is provided at a top of the plurality of pillars, wherein a top end of the support block abuts against a lower surface of a top plate; and a hydraulic jack, configured to jack the top plate, wherein the hydraulic jack is provided with a plurality of intervals at the top of the temporary support column, and wherein the jacking construction method by using the top plate jacking device for V-shaped columns comprises:

S1. drilling a pile hole at a specified location on the construction surface and pouring the cast-in-place bearing platform at a bottom of the pile hole;

S2. assembling the plurality of vertically connected column segments, which are prefabricated, on an outside of the pile hole, and connecting the two adjacent column segments of the plurality of vertically connected column segments above and below through the connecting component; and after a connection is completed, hanging the temporary support pile vertically into the pile hole, so that a bottom of the temporary support pile is inserted on the cast-in-place bearing platform;

S3. after placing the support block on the plurality of pillars, mounting the hydraulic jack at the top of the temporary support column, and placing the top plate on a plurality of the support blocks to form a temporary support to the top plate;

S4. after construction of the V-shaped columns is completed and a strength requirement is met, starting the hydraulic jack to jack the top plate up a certain distance and pulling out the plurality of the support blocks;

S5. removing the hydraulic jack; and

S6. releasing the connection between the two adjacent column segments, and removing the plurality of vertically connected column segments through a cooperation of a crane and a sling.

* * * * *